US012235057B2

(12) United States Patent
Maciunas

(10) Patent No.: US 12,235,057 B2
(45) Date of Patent: Feb. 25, 2025

(54) DEFLECTOR AND GRID SUPPORT ASSEMBLIES FOR USE IN HEAT EXCHANGERS AND HEAT EXCHANGERS HAVING SUCH ASSEMBLIES THEREIN

(71) Applicant: Lindain Engineering, Inc., Pennsauken, NJ (US)

(72) Inventor: Vytautas V. Maciunas, Cherry Hill, NJ (US)

(73) Assignee: Lindain Engineering, Inc., Pennsauken, NJ (US)

( * ) Notice: Subject to any disclaimer, the term of this patent is extended or adjusted under 35 U.S.C. 154(b) by 0 days.

(21) Appl. No.: 17/813,028

(22) Filed: Jul. 15, 2022

(65) Prior Publication Data

US 2023/0013237 A1 Jan. 19, 2023

Related U.S. Application Data

(60) Provisional application No. 63/223,000, filed on Jul. 17, 2021.

(51) Int. Cl.
*F28F 9/22* (2006.01)
*F28F 9/013* (2006.01)

(52) U.S. Cl.
CPC ..... *F28F 9/22* (2013.01); *F28F 9/0131* (2013.01); *F28F 2009/226* (2013.01)

(58) Field of Classification Search
CPC ..... F28F 9/22; F28F 9/0131; F28F 2009/226
See application file for complete search history.

(56) References Cited

U.S. PATENT DOCUMENTS 1,672,650 A 6/1928 Lonsdale
3,958,630 A 5/1976 Smith
(Continued)

FOREIGN PATENT DOCUMENTS

CN 112146491 A 12/2020
CN 112178691 A 1/2021
(Continued)

OTHER PUBLICATIONS

International Search Report and Written Opinion in Counterpart Application PCT/US2022/073818, 12 pages (Nov. 2, 2022).

*Primary Examiner* — Tho V Duong
*Assistant Examiner* — Raheena R Malik
(74) *Attorney, Agent, or Firm* — Calderone McKay LLC

(57) ABSTRACT

Support assemblies are described herein for use with heat exchanges, wherein the assemblies are deflector and grid support assemblies having a grid support structure formed of a series of interconnected strips and having a peripheral exterior configured to be positioned within an interior surface of a heat exchanger such that the grid support structure substantially extends across a transverse cross-section of the interior of a the tube heat exchanger, wherein the grid support has a first grid support surface and an opposite second grid support surface longitudinally spaced from the first grid surface, the grid support structure defines a plurality of passageways extending therethrough from the first to the second grid support surface, the passageways being configured to support longitudinally extending tubes of a heat exchanger passing substantially perpendicularly to the first grid support surface through the passageways from the first grid surface to the second grid surface without substantially obstructing interior flow the heat exchanger; and at least one deflector plate, each having a first deflector plate surface and an opposite second deflector plate surface, wherein the at least one deflector plate defines a plurality of
(Continued)

tube receiving openings therethrough for supporting longitudinally extending tubes in a heat exchanger, the deflector plate configured to cover at least one or more surface areas of the first grid surface to substantially obstruct flow through the deflector plate; wherein the first grid surface is configured to receive the at least one deflector plate to form a deflector and grid support assembly.

16 Claims, 9 Drawing Sheets

(56) References Cited

U.S. PATENT DOCUMENTS 3,964,146 A * 6/1976 Vestre ..... F28F 9/0132 165/162
3,967,677 A * 7/1976 Mohlman ..... F28F 9/22 165/162
4,049,048 A * 9/1977 Leedham ..... F28F 1/325 165/DIG. 417
4,136,736 A * 1/1979 Small ..... F28F 9/22 165/162
4,253,516 A 3/1981 Giardina
4,413,394 A * 11/1983 Small ..... F28F 9/22 29/428
4,441,550 A 4/1984 Chase
4,579,304 A 4/1986 Williams
4,595,161 A 6/1986 Williams
4,823,866 A 4/1989 Hunt
4,828,021 A * 5/1989 Small ..... F28F 9/0132 165/162
4,972,903 A 11/1990 Kwok
5,050,669 A 9/1991 Nenstiel et al.
5,101,892 A * 4/1992 Takeuchi ..... F28F 9/182 165/173
5,291,944 A 3/1994 Sanz et al.
5,323,849 A * 6/1994 Korczynski, Jr. ..... F28F 11/00 165/905
5,355,945 A * 10/1994 Sanz ..... F28F 9/22 165/910
5,615,738 A * 4/1997 Cameron ..... F28F 27/02 165/DIG. 123
5,642,778 A * 7/1997 Gentry ..... F28F 9/0132 165/910
5,644,842 A * 7/1997 Coleman ..... F28F 1/025 29/890.044
5,832,991 A 11/1998 Cesaroni
6,116,041 A * 9/2000 Cassell ..... F25B 39/02 62/199
6,142,215 A * 11/2000 Paulsen ..... F28F 9/22 165/45
6,167,951 B1 * 1/2001 Couch ..... C02F 1/725 165/160
6,513,583 B1 * 2/2003 Hughes ..... F28D 7/1607 165/162
6,808,017 B1 * 10/2004 Kaellis ..... F28F 13/12 165/181
9,593,598 B2 3/2017 Bapat et al.
9,885,523 B2 2/2018 Zimmer et al.
10,295,266 B2 5/2019 Singh et al.
10,386,120 B2 8/2019 Rizzi
2005/0161204 A1 * 7/2005 Johnston ..... F28F 9/0131 165/162
2005/0167089 A1 * 8/2005 Ozeki ..... F28D 7/16 165/162
2006/0289153 A1 * 12/2006 Mulder ..... F28F 9/22 165/162
2009/0200004 A1 8/2009 Johnston et al.
2010/0116477 A1 * 5/2010 Mulder ..... F28F 9/005 29/890.03
2010/0122797 A1 * 5/2010 Seo ..... F28D 7/1661 165/104.19
2010/0282450 A1 11/2010 Mulder
2010/0282451 A1 * 11/2010 Singh ..... F28F 9/0241 165/162
2012/0199330 A1 8/2012 Maurer et al.
2017/0016678 A1 * 1/2017 Singh ..... F28D 7/1646
2019/0128613 A1 5/2019 Singh
2019/0234689 A1 8/2019 Singh et al.
2020/0030743 A1 1/2020 Bruno et al.
2023/0013237 A1 * 1/2023 Maciunas ..... F28F 9/0131

FOREIGN PATENT DOCUMENTS

EP 3 519 752 B1 3/2021
JP 05-296680 A 11/1993

* cited by examiner

DEFLECTOR AND GRID SUPPORT ASSEMBLIES FOR USE IN HEAT EXCHANGERS AND HEAT EXCHANGERS HAVING SUCH ASSEMBLIES THEREIN

CROSS-REFERENCE TO RELATED APPLICATIONS

This non-provisional patent application claims priority to and the benefit under 35 U.S.C. § 119(e) of U.S. Provisional Patent Application No. 63/223,000, filed Jul. 17, 2021 entitled, "Deflector and Grid Support Assemblies for Use in Heat Exchangers and Heat Exchangers Having Such Assemblies Therein," the entire disclosure of which is incorporated herein by reference.

BACKGROUND OF THE INVENTION

Field of the Invention

The invention is related to the field of heat exchangers, and particularly but not limited to shell and tube heat exchangers, with respect to heat exchange tube supports that are economical and practical to manufacture and that provide individual support bidirectionally in a given transverse cross-section of a heat exchanger, while also creating an efficient flow pattern to increase heat transfer without inhibiting generally axial flow over and around tubes in a heat exchanger and while preferably minimizing pressure loss

Description of Related Art

Heat exchangers are known in the art and available in many designs, among them, one of the most common is a shell and tube heat exchanger. Such shell and tube heat exchangers are well known and have been used in many industries, with particular primary industrial uses in the petrochemical, power and chemical process industries. Such shell and tube heat exchangers are employed to transfer heat between fluids operating over a range of pressures from full vacuum to about 10,000 psig, and a range of temperatures from −300° F. to 1,800° F. Due to the inherent ruggedness of a shell and tube heat exchanger construction, this class of heat exchange equipment remains a primary choice in industrial applications.

In this class of heat exchangers, heat is exchanged between two fluids across the wall of the thin tubing, typically ranging in thickness from 0.028 to 0.109 inches. See, Standards of Tubular Exchanger Manufacturers Association, Mechanical Standards TEMA Class RCB. Tubing is generally supported within the shell cylinder at intervals along the tube length. Tube ends may be attached securely by a tube expansion and/or welding process to drilled plates, called tube sheets, which are welded to the shell cylinder or bolted to a shell flange that has been welded to the cylinder. The end tube sheets are generally designed to create two fluid compartments for fluid inlet and outlet flow.

In a simple design shell and tube heat exchanger, with a single pass, straight tube design construction, fluid flows on the outside of the heat exchanger tubes (shell-side flow) and enters at one end of the shell cylinder and exits at the other end of the shell cylinder. The other fluid enters the tubes at one end and exists at the other end (tube-side flow). A cylinder, typically called a channel section is welded or bolted to the tube sheets located at the ends of the cylinder to create an inlet and exit "header" for the tube-side fluid.

Because the tubes are typically of a small outside diameter, (typically between 0.25 in. to about 1.5 in.), intermediate support at one or more points along the length of the tubes has been used in the art to prevent excess deflection due to tube metal and contained fluid weight and to prevent flow-induced tube vibration during operation that may lead to their mechanical failure from repeated collisions with adjacent tubes or fretting wear of the tube material at the supports from oscillatory-induced motion of the tubes.

In early designs, tubes in shell and tube heat exchangers were supported solely by drilled plates (known as single segmental baffles) that extended partly across the shell cylinder transversely creating full support at every second plate, while allowing flow to pass through the shell from one end to the other. Subsequently, double segmental drilled baffles were introduced to split the shell flow into two streams to reduce the number of tube rows crossed by the shell side fluid in passing through the heat exchanger to minimize velocity of the shell side flow and pressure loss as it crossed the tubes.

Further reduction in pressure drop and velocity was achieved by using triple segmental baffles to further subdivide the internal shell flow streams. By increasing the segmentation and distance between adjacent flow baffles, the flow through the shell began to approach axial flow. See, V. Maciunas, P. E., "Evolution of HX Tube Supports and Use of Non-Segmental Baffles to Improve Performance and Reliability of Feedwater Heaters," Presented at EPRI Feedwater Symposium, Kansas City, Missouri, September 1995.

As an alternative to drilled plates, the use of grid supports to enable more, pure axial flow was introduced. "Rod baffles" were one such type of support that facilitated axial flow of shell side fluid by creating a tube support apparatus using rod assemblies with an alternating orientation with respect to a horizontal plane through the center of shell cylinder. The rod assemblies were mostly used in petrochemical and chemical process industries with gas and condensing vapor flow in the shell.

Lattice grids were developed by creating an assembly of intersecting strips such that the tube would be supported bidirectionally in the transverse plane through the shell. An example of a lattice grid may be found in U.S. Pat. Nos. 4,579,304 and 4,595,161. Such structures were used primarily in the power industry to provide primary and/or supplemental support in surface condensers, feedwater heaters and component cooling water heat exchangers, because they were compatible with densely packed tube bundles to minimize spatial requirements.

The above-noted rod baffles were used primarily with a square pitch tube arrangement, while the lattice grid baffles noted were used primarily with a triangular pitch tube layout arrangement. In such axial flow designs, the rod diameter or the strip thickness were selected to match the space created by the lanes in the tube layout to develop the tube support. The strip thickness, for example, would be such as to align and closely support the tubes while allowing fluid flow through the grid and around the tubes axially.

For a triangular pitch tube layout, the repetitive lattice element, e.g., may form a diamond-shaped configuration and the actual thickness of the strip may be selected to match the nominal width of the tube lane created by the specific tube outside diameter and tube pitch combination.

While the rod baffles and a grid structural arrangements minimized pressure drop and minimized flow-induced tube vibration problems, the lack of an oscillating cross flow component to create turbulence also reduced the heat transfer coefficient and hence the thermal/hydraulic efficiency of the design.

A need in the art remains for further improvements in heat exchangers, such as shell and tube heat exchangers, for a tube support that would induce sufficient turbulence to improve the heat transfer coefficient and the thermal and hydraulic efficiency in heat exchanger, minimal pressure loss, and provide good resistance to flow-induced tube vibration, while also minimizing the weight and manufacturing costs.

BRIEF SUMMARY OF THE INVENTION

The invention herein addresses the above-noted need in the art by providing better thermal efficiency in heating and cooling in heat exchangers, such as, for example, in shell and tube heat exchangers, and better hydraulic efficiency, while minimizing tube vibration and reducing pressure drops by allowing for substantially axial shell side flow through and around tubes in the heat exchanger using integral deflector and grid tube support assemblies described herein, and also providing a reduction in weight and manufacturing costs. The integration of grids and deflector plates as an assembly facilitates the separation of the tube support function of the grid plates from the heat transfer augmentation function of the deflector plates. The deflector plates in using sequential assemblies according to the disclosure herein do not require an overlap to develop a support structure to carry the installed tube weight and resist flow induced forces. The invention by using assemblies as described herein provides for a large number of variations and combinations of deflector shapes and sizes that can be integrated within the core grid structure as guided by use of Computational Fluid Dynamics (CFD) to optimize heat transfer against pressure loss.

In one embodiment, the invention includes a deflector and grid support assembly for use in a heat exchanger, comprising: a grid support structure formed of a series of interconnected strips and having a peripheral exterior configured to be positioned within an interior space defined by an interior surface of a shell of a heat exchanger such that the grid support structure substantially extends across a transverse cross-section of the interior of a shell of a heat exchanger, wherein the grid support has a first grid surface and an opposite second grid surface longitudinally spaced from the first grid surface, the grid support structure defines a plurality of passageways extending therethrough from the first grid support surface to the second grid support surface, the passageways being configured to support longitudinally extending tubes passing substantially perpendicularly to the first grid support surface through the passageways from the first grid surface to the second grid surface without substantially obstructing longitudinal flow in around the tubes; and at least one deflector plate, each deflector plate having a first deflector plate surface and an opposite second deflector plate surface, wherein the at least one deflector plate defines a plurality of tube receiving openings therethrough for supporting longitudinally extending tubes in a heat exchanger, the deflector plate configured to cover at least one or more surface areas of the first grid surface to substantially obstruct flow through the deflector plate; wherein the first grid surface is configured to receive the at least one deflector plate to form a deflector and grid support assembly.

In one embodiment herein, the grid support structure in the assembly has a first area having a first thickness measured longitudinally from the first grid surface to the second grid surface and a second area having a second thickness measured longitudinally from the first grid surface to the second grid surface, wherein the first area is on at least one exterior area of the grid support structure, the first thickness is less than the second thickness and the at least one exterior area having the first thickness is configured to receive and seat the at least one deflector plate.

In another embodiment, the grid support structure has a first area having a first thickness measured longitudinally from the first grid surface to the second grid surface and a second area having a second thickness measured longitudinally from the first grid surface to the second grid surface, wherein the first area is on at least one central area of the grid support structure, the first thickness is less than the second thickness, and the at least one central area is configured to receive and seat the at least one deflector plate.

The interconnected strips of the grid support structure may comprise a metal, a metal alloy, a polymer and/or a polymeric composite. The interconnected strips, when viewed from the first or the second grid surface define passageways which passageways may have a shape selected from a diamond, a triangle, a parallelogram, e.g., a square or a rectangle, an ellipse and a circle. The peripheral exterior of the grid support structure may be seated within a containment structure. The grid support surface may be configured to be installed in heat exchanger so that the first grid surface and the at least one deflector plate contact upstream fluid flow.

In one embodiment, the heat exchanger is a shell and tube heat exchanger, and the peripheral exterior of the grid support structure is configured to be positioned with a shell of the shell and tube heat exchanger. In such an embodiment, the first grid surface and the at least one deflector plate preferably contact upstream shell-side flow. While optional only, as the tubes are supported in the deflector within the tube receiving openings, in one embodiment, if desired, at least a portion of the tube receiving openings in the deflector plate may be configured so that, upon installation, a portion of the deflector plate that defines the tube receiving openings is situated to be welded to tubes in a heat exchanger, such as in a shell and tube heat exchanger, passing therethrough. In another optional embodiment, at least a portion of the tube receiving openings in the deflector plate may also be configured so that, upon installation, the deflector plate allows for thermal expansion of tubes in a heat exchanger, such as a shell and tube heat exchanger, passing therethrough.

In yet a further embodiment of the deflector and grid support assembly noted above for use in a heat exchanger, there may be at least three deflector and grid support assemblies, each of which assemblies has a grid support structure having a first area and a second area, wherein: a first deflector and grid support assembly may be configured to have a first deflector plate that is configured as a first ring-shaped plate having an exterior edge and an interior edge, the interior edge defining an opening in a central portion of the deflector plate, the first deflector plate positioned in the first area defined along an outer periphery of the grid support structure of the first deflector and grid support assembly to allow for substantially axial flow through a central second area in the grid support structure which is not in obstructed by the first deflector plate; a second deflector and grid support assembly may be configured to have a second deflector plate that is configured as a second ring-shaped plate having an exterior edge an and an interior edge, the interior edge defining an opening in central portion of the second deflector plate, the second deflector plate positioned in a first area of the grid support structure of the second deflector and grid support assembly to allow for substantially axial flow through a second area of the grid structure of the second deflector and grid support assembly including an exterior peripheral region and a central region, each of which is not obstructed by the second deflector plate; and a third deflector and grid support assembly may be configured to include a third deflector plate that is configured as a round plate positioned in a central first area of the grid support structure of the third deflector and grid support assembly to allow for substantially axial flow through a second area of the grid structure of the third deflector and grid support assembly that includes an exterior peripheral region which is not obstructed by the third deflector plate.

The invention may also include methods of heating or cooling a fluid in a shell and tube heat exchanger, comprising positioning within a shell of the shell and tube heat exchanger at least one, two or three of the various deflector and grid support assemblies described above, each having one or more deflector and grid support assemblies for receiving and supporting tubes in the shell and tube heat exchanger.

In another embodiment herein, the invention includes a heat exchanger having a deflector and grid support assembly, comprising a longitudinally extending shell having an exterior surface and an interior surface defining an interior space, the shell defining an inlet for shell side fluid entering the interior space of the shell, an outlet for shell side fluid exiting the interior space of the shell, an inlet for tube side fluid entering the interior space of the shell and an outlet for tube side fluid exiting the interior space of the shell; a plurality of longitudinally extending tubes, each having an inlet on one end and an outlet on an opposite end, wherein the tubes are supported on at least one end by a tube support structure and wherein each tube inlet is in fluid communication with the tube side fluid inlet of the shell and each tube outlet is in fluid communication with the tube side fluid outlet of the shell; and at least one deflector and grid support assembly, each deflector and grid support assembly comprising a grid support structure formed of a series of interconnected strips and having a peripheral exterior configured to be positioned within the interior space of the shell such that the grid support structure substantially extends across a transverse cross-section of the interior space of the shell, wherein the grid support has a first grid surface and an opposite second grid surface longitudinally spaced from the first grid surface, the grid support structure defines a plurality of passageways extending therethrough from the first grid support surface to the second grid support surface, the passageways being configured to support a first portion of the longitudinally extending tubes so that the tubes pass substantially perpendicularly through the first grid support surface within the passageways from the first grid surface to the second grid surface without substantially obstructing flow exterior to the longitudinally extending tubes positioned in the passageways; at least one deflector plate, each deflector plate having a first deflector plate surface and an opposite second deflector plate surface, wherein the at least one deflector plate defines a plurality of tube receiving openings therethrough for supporting a second portion of the longitudinally extending tubes, the deflector plate configured to cover at least one or more surface areas of the first grid surface to substantially obstruct flow through the deflector plate; and wherein the first grid surface is configured to receive the at least one deflector plate to form a deflector and grid support assembly.

In one embodiment of the above-described heat exchanger, the grid support structure may have a first area having a first thickness measured longitudinally from the first grid surface to the second grid surface and a second area having a second thickness measured longitudinally from the first grid surface to the second grid surface, wherein the first area is on the at least one exterior area of the grid support structure and the first thickness is less than the second thickness and the at least one exterior area having the first thickness is configured to receive and seat the at least one deflector plate.

In another embodiment of the heat exchanger noted above, the grid support structure may have a first area having a first thickness measured longitudinally from the first grid surface to the second grid surface and a second grid area having a second thickness measured longitudinally from the first grid surface to the second grid surface, wherein the first area is on at least one central area of the grid structure and the first thickness is less than the second thickness and the at least one central area is configured to receive and seat the at least one deflector plate.

In a further embodiment of the heat exchanger, there may be at least two deflector and grid support assemblies, including, for example, a first deflector and grid support assembly and a second deflector and grid support assembly and wherein the fat least one deflector plate may include a first deflector plate and a second deflector plate. In such an embodiment, (a) the first deflector and grid support assembly may have a first area having a first thickness measured longitudinally from the first grid surface to the second grid surface and a second area having a second thickness measured longitudinally from the first grid surface to the second grid surface, wherein the first area of the first deflector and grid support assembly is on at least one exterior area of the grid support structure, the first thickness is less than the second thickness and the at least one exterior area having the first thickness is configured to receive and seat a first deflector plate and (b) the second deflector and grid support assembly may have a first area having a first thickness measured longitudinally from the first grid surface to the second grid surface and a second area having a second thickness measured longitudinally from the first grid surface to the second grid surface, wherein the first area of the second deflector and grid support assembly is on at least one central area of the grid support structure, the first thickness is less than the second thickness, and the at least one central area is configured to receive and seat a second deflector plate.

Further, in such an embodiment, the first deflector and grid support assembly and the second deflector and grid support assembly noted above may be positioned within the heat exchanger shell so that the at least one deflector plate of the first deflector and grid support assembly is not axially aligned with the at least one deflector plate of the second deflector and grid support assembly. The deflector plates on each of the first deflector and grid support assembly and the second deflector and grid support assembly noted above, may also preferably be installed within the shell so that the first surfaces of each of the deflector plates and the first surface of each of the grid support structures are facing upstream shell side flow through the shell of the heat exchanger.

In a further embodiment of the shell and tube heat exchanger, the heat exchanger is a shell and tube heat exchanger and each of the first and the second grid support assemblies may have a first surface of the grid support structure having a first area and a second area, and the first deflector and grid support assembly may have two deflector plates that are configured as arcuate end plates in the first area of the first deflector and grid support assembly, wherein each arcuate end plate is separated to allow for substantially axial flow through a central grid support in the second area of the grid support structure of the first deflector and grid support assembly, and the second deflector and grid support assembly may have one central deflector plate in the first area of the grid support structure of the second deflector and grid support assembly, the central deflector plate positioned to allow substantially axial flow through arcuate shaped end regions of the grid support structure in the second area thereof, and wherein the first and the second deflector and grid support assemblies are positioned to direct shell side flow to pass substantially axially through the second areas of the first and the second deflector and grid support assemblies and to substantially obstruct axial flow through the first areas of the first and the second deflector and grid support assemblies.

In such an embodiment, the heat exchanger may comprise a plurality of deflector and grid support assemblies that comprise alternating deflector and grid support assemblies having the design of the first deflector and grid support assembly and the design of the second deflector and grid support assembly positioned along a length of the shell, which length is measured in a longitudinal direction, to create an alternating shell side flow pattern to increase heat transfer without inhibiting generally axial flow over and around the tubes.

In a further embodiment of the heat exchanger noted above, there may be at least three deflector and grid support assemblies, each of which assemblies has a grid support structure having a first area and a second area, wherein, in one such embodiment, a first deflector and grid support assembly may have a first deflector plate that is configured as a first ring-shaped plate having an exterior edge and an interior edge, the interior edge defining an opening in a central portion of the deflector plate, the first deflector plate positioned in the first area defined along an outer periphery of the grid support structure of the first deflector and grid support assembly to allow for substantially axial flow through a central second area in the grid support structure which is not in obstructed by the first deflector plate; a second deflector and grid support assembly may have a second deflector plate that is configured as a second ring-shaped plate having an exterior edge an and an interior edge, the interior edge defining an opening in central portion of the second deflector plate, the second deflector plate positioned in a first area of the grid support structure of the second deflector and grid support assembly to allow for substantially axial flow through a second area of the grid structure of the second deflector and grid support assembly including an exterior peripheral region and a central region, each of which is not obstructed by the second deflector plate; and a third deflector and grid support assembly may have a third deflector plate that is configured as a round plate positioned in a first central area of the grid support structure of the third deflector and grid support assembly to allow for substantially axial flow through a second area of the grid structure of the third deflector and grid support assembly that includes an exterior peripheral region which is not obstructed by the third deflector plate.

In such an embodiment, the first, the second and the third deflector and grid support assemblies may position positioned so as to be alternating assemblies having a design of each of the first, the second and the third grid support assemblies positioned along a length of the shell of a heat exchanger, the length measured in a longitudinal direction, to create an alternating shell side flow pattern to increase heat transfer without inhibiting generally axial flow over and around the tubes.

In various embodiments herein, connection of deflector plates to grid support structures can be accomplished by welding, bolting and other mechanical means. The invention includes that for some materials, the grid support structure and deflector plate construction can be molded as assemblies or fabricated as a unit by other manufacturing techniques

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
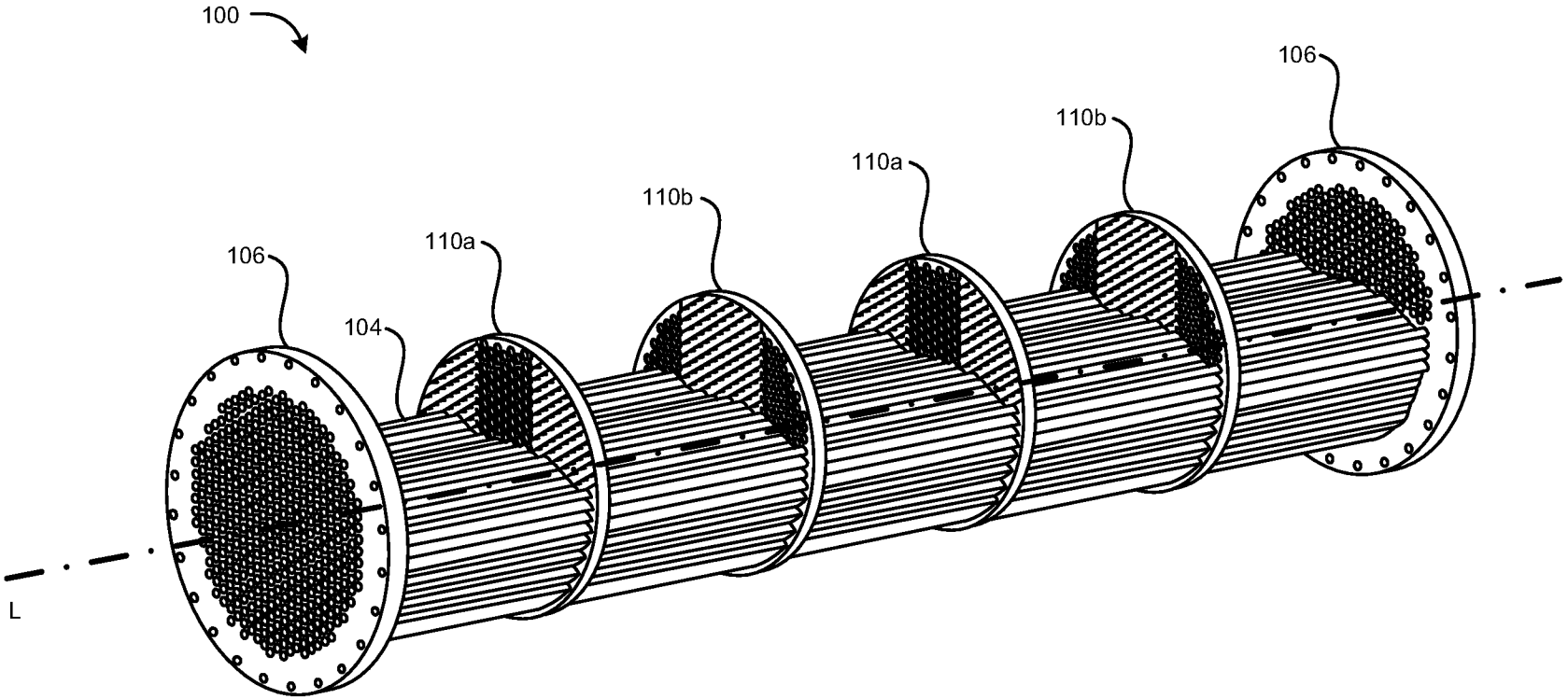
FIG. 1 is a perspective view of a partial tube bundle for use in a shell and tube heat exchanger including end tube sheets and a plurality of alternating first and second designs of grid support and deflector assemblies according to an embodiment herein.

The invention herein includes deflector and grid support assemblies which may be used in shell and tube heat exchangers and heat exchanges having such assemblies therein, which can be used to provide variations in alternating flow patterns through the deflector and grid support assemblies to allow the heat exchanger design to be modified or tailored to provide a desired level of axial flow while improving tube contact, reducing tube vibration and minimizing sudden or extreme pressure drops from turbulent flow or too much transverse cross-current flow within the shell of the heat exchanger. The assemblies herein are improvements over various prior art structure attempts to achieve a balance in thermal properties, pressure consistency and tube stability and may be varied to provide modifications for different exchanger designs and flow patterns. The integration of grids and deflector plates as an assembly facilitates the separation of the tube support function of the grid plates from the heat transfer augmentation function of the deflector plates. The deflector plates in using sequential assemblies according to the disclosure herein do not require an overlap to develop a support structure to carry the installed tube weight and resist flow induced forces. The invention by using assemblies as described herein provides for a large number of variations and combinations of deflector shapes and sizes that can be integrated within the core grid structure as guided by use of Computational Fluid Dynamics (CFD) to optimize heat transfer against pressure loss.

As used herein, words such as "interior" and "exterior," "inner" and outer," "upwardly" and "downwardly," "inwardly" and "outwardly," "radially" and "circumferentially," "upstream" and "downstream," "higher" and "lower," "top" and "bottom," "left" and "right," "horizontally" and "vertically" and "distal" and "proximal" and words of similar import refer to directions in the drawings in accordance to their ordinary meaning and are for assisting in clarifying the features of the invention unless otherwise specified. As used herein "fluid communication" means that a fluid, whether a liquid, a gas or vapor, flows from one component to another component, either directly, or indirectly through one or more intervening components, wherein the intervening components may be, for example, conduits, pipes, valves, gates, doors, dividers, or an open space such as a manifold, a plenum, an opening defined in a component such as a tube sheet, a grid or other tube support and the like.

Reference herein to a "heat exchanger" is intended to mean an apparatus used for transferring heat between two or more fluids either for either a cooling or heating process. Reference herein to "shell and tube heat exchangers" or "tubular heat exchanger" are intended to refer to a classes of heat exchangers commonly use in thermal heating and cooling of, e.g., liquids and gasses, boiling of liquids and condensing of vapors. Shell and tube heat exchangers typically include a vessel, such as a larger pressure-vessel, known as a "shell" or housing through which fluid flows from an inlet to an outlet. Within the shell are one or more tubes, which may be individual tubes or one or more tube bundles flowing typically lengthwise (longitudinally) through the shell. The shells may be oriented vertically or horizontally with respect to a support surface on which a shell is mounted. In referring to flow through the shell, with respect to the ground or other shell support surface, flow may be horizontal or vertical and still extend longitudinally through the shell.

In the present application, reference to flow extending longitudinally through the shell means flow passing through the shell in a direction that is lengthwise or over the longest dimension of the shell from one end to another. As shown in the drawings, flow extends in a direction generally parallel to a horizontally extending configuration for convenience only and such orientation should not be interpreted to be limiting. Flow in the shell herein may be single pass flow (meaning going once across the shell lengthwise) or double or multiple pass flow (meaning the flow may traverse the shell more than once lengthwise before exiting the shell). While the drawings show a single pass flow for easily explaining the benefits of the invention, one skilled in the art, based on the disclosure, will readily comprehend the applicability of the deflector and grid support assemblies herein for a wide variety of single pass, multiple pass and stacked configuration flow arrangements as well as in a variety of shell configurations including the single or multiple use of end support standard tube sheets in addition to the assemblies herein.

The deflector and grid support assemblies herein may be further used alone or in combination with other known grid supports, rod supports or prior art designs either as an improvement to such designs, intermingled with such designs or as a replacement of prior art designs. The deflector and grid support assemblies may also be used in one heat exchanger shell, in a group of heat exchanger shells in series, or in all heat exchangers in series.

Flow within the shell extending in a direction contrary to longitudinal flow will be referred to herein as non-axial flow, transverse flow, or cross-current flow. Transverse flow may be flow moving in a direction that is across or generally orthogonal to the general direction of lengthwise flow. However, non-axial flow or cross-current flow may also be flow having elements of axial and non-axial flow that is not fully axial flow. It is understood further herein that reference to "axial" flow is a reference to lengthwise flow along, or generally parallel to, the longitudinal axis of the shell of the heat exchanger. It will be understood to those of skill in the art based on this disclosure that fluid flow, by its nature, if not ideally laminar, may have variations in flow and that reference to flow that is generally axial is meant to convey that the general direction of flow extends lengthwise and in the axial direction of the shell, and that substantially axial flow is meant to convey that the flow is primarily in the lengthwise, axial direction of the shell. Such axial flow may also occur flow within and around and over longitudinally extending tubes, with preferably a controllable or lower level of turbulence or cross-current flow.

It should also be understood, based on this disclosure, by one skilled in the art that the invention as described herein is not limited to use in cylindrical shells or to exchangers with primarily axial flow streams, and instead may be employed in varying outer shells or vessels, such as rectangular vessels or in containment structures of other shapes and with varying internal tube arrangements. For example, in addition to straight tube, the deflector and grid support assemblies can be used to support U-tubes, hairpin tubes and J-tubes that are installed in single shells, twin parallel shell connected with an integral manifold or two perpendicular shells connected by a mitered weld or elbows of selected radius, respectively. Examples of such configurations may be found in the prior art. See, e.g., K. P. Singh et al, *Mechanical Design of Heat Exchangers and Pressure Vessel Components*, Springer-Verlag Berlin Heidelberg (1984), pp. 6, 10 with respect to U-tubes and hairpin tubes (available to review: https://books.google.com/books?id=lt95BgAAQBAJ&printsec=frontcover#v=onepage&q&f=false; and see also, http://www.josephoat.com/products/shell-and-tube-heat-exchangers/#jp-carousel-10532 with respect to J-tubes.

"Fluid" herein is intended to refer to liquids, gasses, including air, water vapor, mixtures of liquids and gasses, steam, superheated steam, coolants, heating agents and a wide variety of related materials that are used for heating or cooling using shell and tube heat exchangers through thermal exchange therein.

The deflector and grid support assemblies herein may be used alone or with baffles or other structures known for use in heat exchangers, but preferably only if such other prior art structures contribute to enhancing the heat exchange properties or otherwise improving overall function.

Use of the term "shell-side" flow refers to flow within a shell originating in a shell-side inlet for introducing a fluid to the interior of the shell that will leave through a "shell side outlet". The shell side flow, as noted above, may be single pass or multiple pass flow within the shell, and while such inlets typically introduce shell side fluid on an end of the shell opposite the introduction of tube-side flow, this is not necessarily the case and would not be required in practicing the invention herein.

Use of the term "tube-side" flow is flow within a heat exchanger that is introduced into the tubes from a tube-side inlet into the shell in fluid communication with an inlet to one or more generally longitudinally extending tubes, and that exits the heat exchanger through a tube-side outlet in the shell in communication with one or more outlets of the generally longitudinally extending tubes. In many heat exchanger designs, such fluid communication is provided to the individual tube inlets or outlets through an open structural area (a plenum) defined between one end of the shell, a tube sheet (support sheet) welded or connected in some manner to at least one end of the longitudinally extending tubes and, in some instances, may include a further divider, e.g., extending in a longitudinal plane between the tube sheet and the shell to separate tube inlet and tube outlet flow. Such structures, inlet and outlet designs and flow division is well known in the art, and can be modified in a variety of ways. A simple design is used for illustrating the function and design of the deflector and grid support assemblies herein, but such design as presented should not be considered to be limiting.

Heat exchangers may be of a variety of designs and end uses and benefit from the deflector and grid support assemblies herein. For example, industrial shell and tube heat exchangers are known and employed for use in electrical and steam generating power plants, nuclear power plants for heating, condensing (such as for condensing exhaust steam from a steam turbine), cooling and the like.

Tubes herein may be formed of a variety of materials but for most industrial applications, use of materials with good heat transfer are preferred. Generally metals and metal alloys are used, such as brass, a variety of stainless steel alloys, copper alloys, titanium, nickel alloys, austenitic nickel-chromium-based superalloys (Inconel®), nickel molybdenum (Hastalloy®), and the like depending on the end application, structural and thermal requirements. Selection of tubing material is application and environmentally driven and driven by industry specifications and requirements as well as cost and thermal properties (such as mechanical strength, corrosion resistance and the coefficient of thermal expansion).

Various equipment typically used with shell and tube heat exchangers in various end applications may be employed herein without departing from the spirit and scope of the invention which is the use and integration of deflector and grid support assemblies as described further herein. As such equipment and shell and tube heat exchangers are well known in the art, the details of their operational and installation specifics, and structural optional or extraneous fixtures are omitted herein for brevity except, when necessary, to explain operation of the deflector and grid support assemblies of the present invention.

The invention will now be illustrated with respect to various preferred embodiments of the deflector and grid support assemblies and with reference to FIGS. 1-11.

With respect to embodiments in FIGS. 1-FIG. 8, FIG. 8 shows an interior tube assembly in partial view for use within a heat exchanger. The deflector and tube assembly will be illustrated with respect to two variations having different placement of deflectors each of which can be used individually in different heat exchanger and tube arrangements or can be used together in the same heat exchanger and internal tube bundle. To illustrate a preferred embodiment of the assembly, two assemblies will be illustrated within a single heat exchanger having such assemblies installed therein, in heat exchanger embodiment 100 shown in a representative manner in FIG. 8, wherein the heat exchanger is generally referred to as heat exchanger 102 having tube bundle 104 as best seen in partial view with the deflector and grid support assemblies exposed in FIG. 1. For clarity, the tube bundle is not shown in detail in FIG. 8 to illustrate the deflector and grid support assemblies as well as a flow pattern without the view of the tubes obstructing such items. As seen in FIG. 1, tubes extend longitudinally along and/or parallel to a central, longitudinal axis L-L' through the tube bundle 104 and shell 108. On either end of the tube bundle 104 is an end plate (tube sheet) 106. The tubes 104 extend over much of the length of the heat exchanger 102 and are located within the shell 108 of the heat exchanger 102 (see FIGS. 1 and 8).

The shells and tubes, as noted above may be of a typical type found in standard industry shell and tube heat exchangers, but can be varied and still find benefit when used in combination with the deflector and grid support assemblies herein. Such assemblies are shown herein generally as deflector and grid support assembly 110. Two variations of such assemblies 110 are shown and are referred to herein as first and second deflector and grid support assemblies 110*a*, 110*b*, wherein 110*a* is illustrated in further detail in FIGS. 2-4 and 110*b* is illustrated in further detail in FIGS. 5-7. Use of alternating assemblies starting on an upstream shell-side flow with 110*a* in FIG. 8 or with 110*b* in FIG. 1 are illustrated in a representative manner herein. It should be understood that the order, type and number of such assemblies 110 may be varied for different flow directional effects, levels of tube support, heat exchange efficiency or tube support, depending on the shell and tube heat exchanger design into which they are introduced. Further, other designs having open flow through grid structures and obstructed shell flow in view of deflectors in terms of the shape and positioning of deflectors or the other shape of the assemblies may also be used within the scope of the invention.

Grid supports are known in the art and are typically formed of a rigid support material, preferably one that will not interfere and/or may help in thermal transfer efficiency. Grids in the art are typically formed of metals or metal alloys, much like the tubes, but for strength are primarily formed of enhanced strength alloys, such as stainless steel in sheet form to make interconnected strips. Other metals as noted above for the tubes may also be used. For the assemblies herein, interconnecting strips formed of the same or similar materials used for forming interconnected strips are joined or otherwise connected, for example, by welding, slots, fasteners and any other means of interconnecting metal sheets or sheet in strip form.

Figure 2:
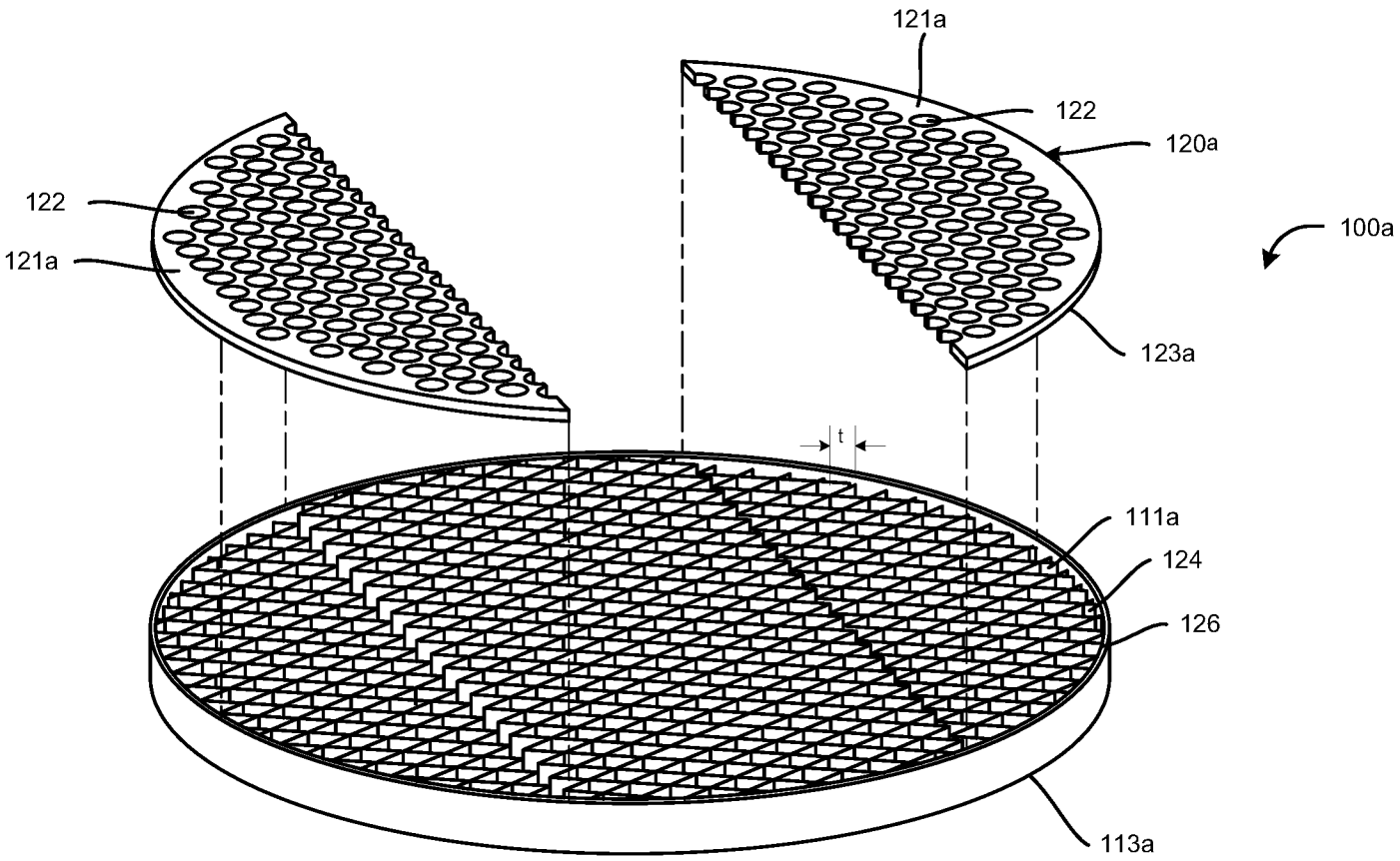
FIG. 2 is an exploded perspective view of a first grid support and deflector assembly according to an embodiment herein wherein deflector inserts are provided on either side of the assembly leaving an open grid support area between the deflector inserts.

Such strips as used in the present invention are preferably of a desired support strip thickness t as measured across the narrowest dimension of the strips taken along a first surface 111*a*, 111*b* of assemblies 110*a*, 110*b*, respectively at an edge of a strip as shown, for example in FIG. 2. The thickness may be varied for different deflector and grid support assemblies in accordance with the level of structural support desired, ranging for example, in preferred embodiments from about 0.028 in. to about 0.083 in., although this can be varied in different end applications.

The interconnections areas where the strips may be interlocking or otherwise connected are spaced by a designed pitch p of the support tubes measured from the center of one passageway 118 within the grid to the center of the next, adjacent passageway. The passageways pass through the grid strips 119 in the grid support structures 112 herein. The grid support structures 112 used in the assemblies 110 herein may be formed using the same design principles for the grid portion's structural make-up. It will be understood by one skilled in the art, based on this disclosure, that the design of the grid support structures in terms of size, pitch and materials as well as shape and design may be altered for different arrangements based on the overall installation and operational conditions.

In addition to standard materials such as the metals and alloys noted above, and depending on the desired end use, high-temperature and wear-resistant aromatic polymers and/or composites may be used for forming the grid support structures, enabling heat molding formation in certain grid support structures. For example, polyarylenes such as PEEK, polyethersulfones, polyethersulfides, polyimides, polytetrafluoroethylene or composites thereof may be used in certain thermal and design environments.

Figure 3:
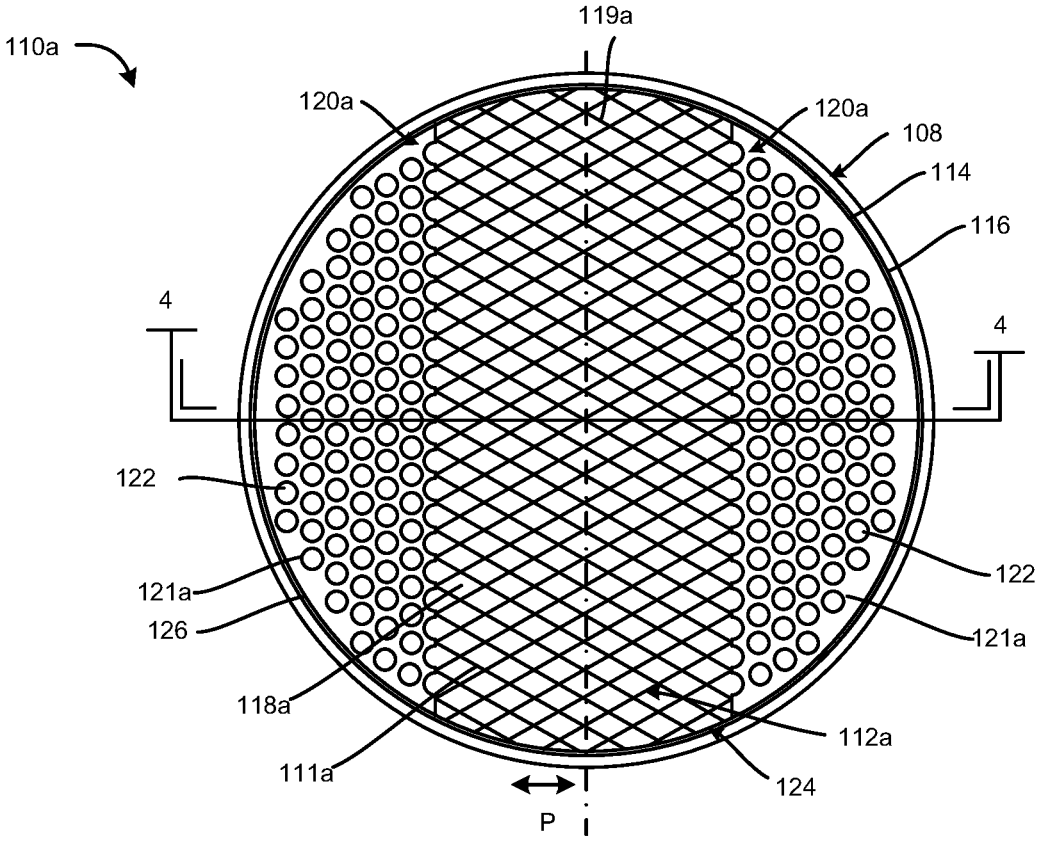
FIG. 3 is a top elevational view of the first grid support and deflector assembly of FIG. 2 taken along line 3-3 in FIG. 8.
Figure 4:
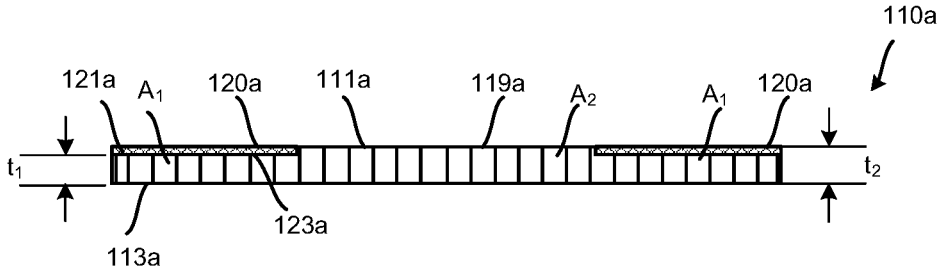
FIG. 4 is a cross-sectional, side elevational view of the first grid support and deflector assembly of FIG. 2 taken along the line 4-4 in FIG. 3.
Figure 5:
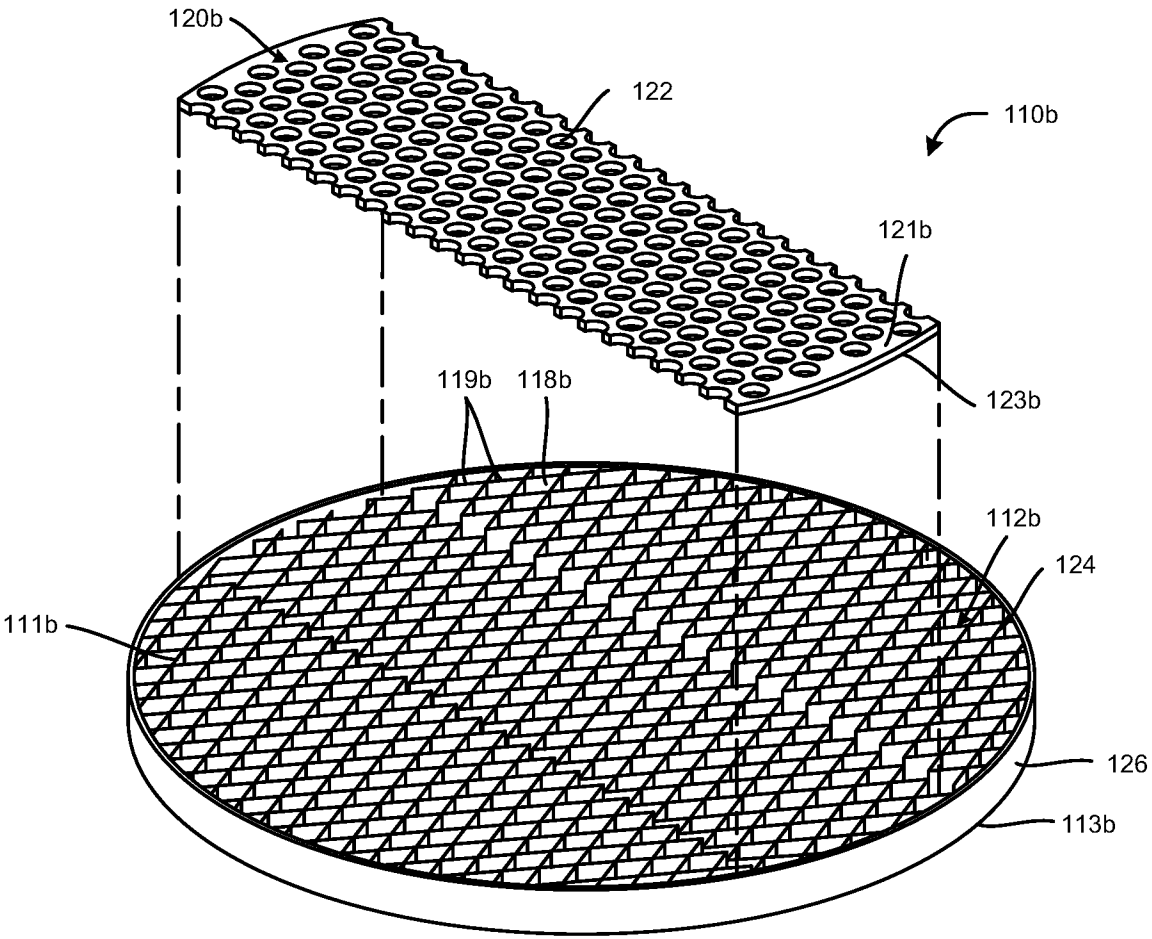
FIG. 5 is an exploded perspective view of a second grid support and deflector assembly according to an embodiment herein wherein a deflector insert is provided in a central area of the assembly between two open grid support areas.
Figure 6:
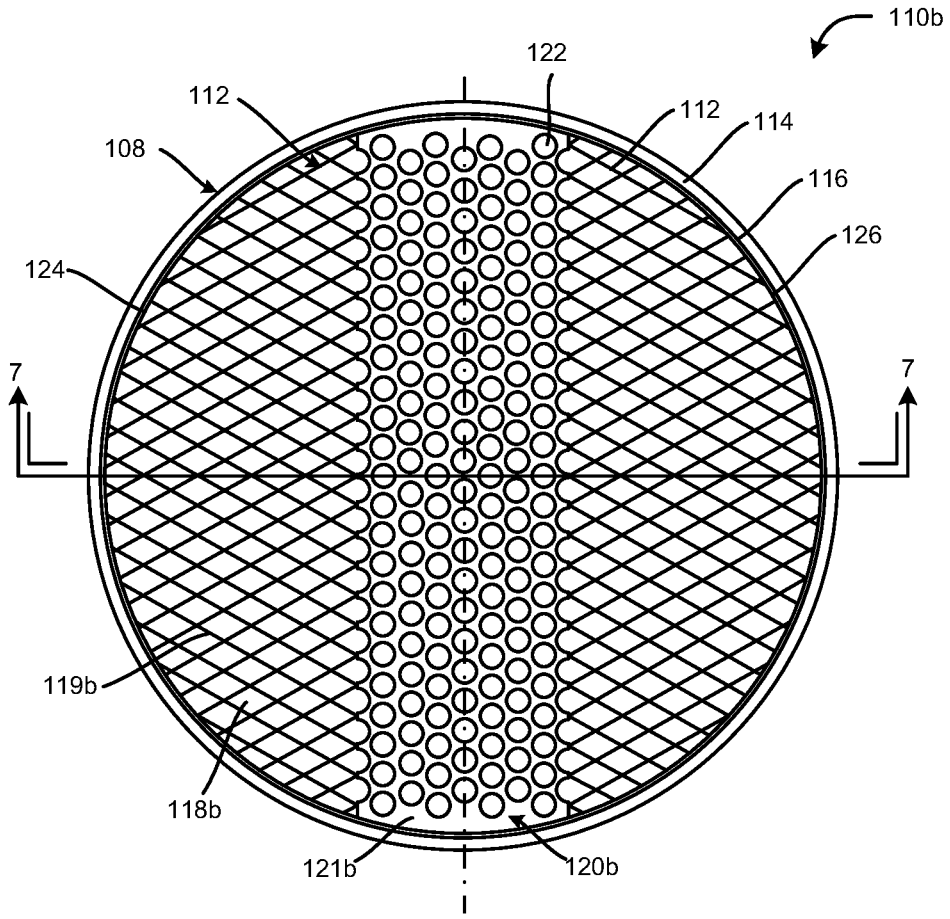
FIG. 6 is a top elevational view of the second grid support and deflector assembly of FIG. 5 taken along line 6-6 in FIG. 8.
Figure 7:
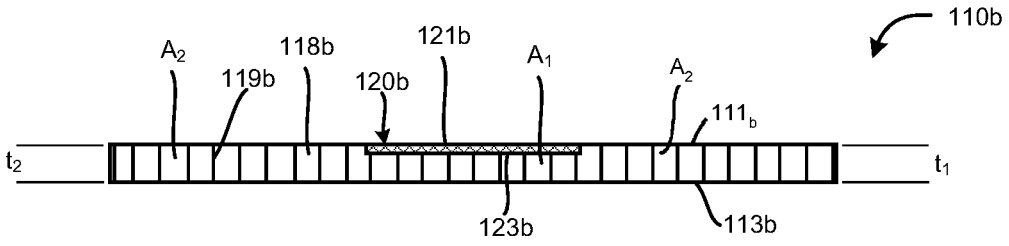
FIG. 7 is a cross-sectional, side elevational view of the second grid support and deflector assembly of FIG. 5 taken along line 7-7 in FIG. 6.
Figure 8:
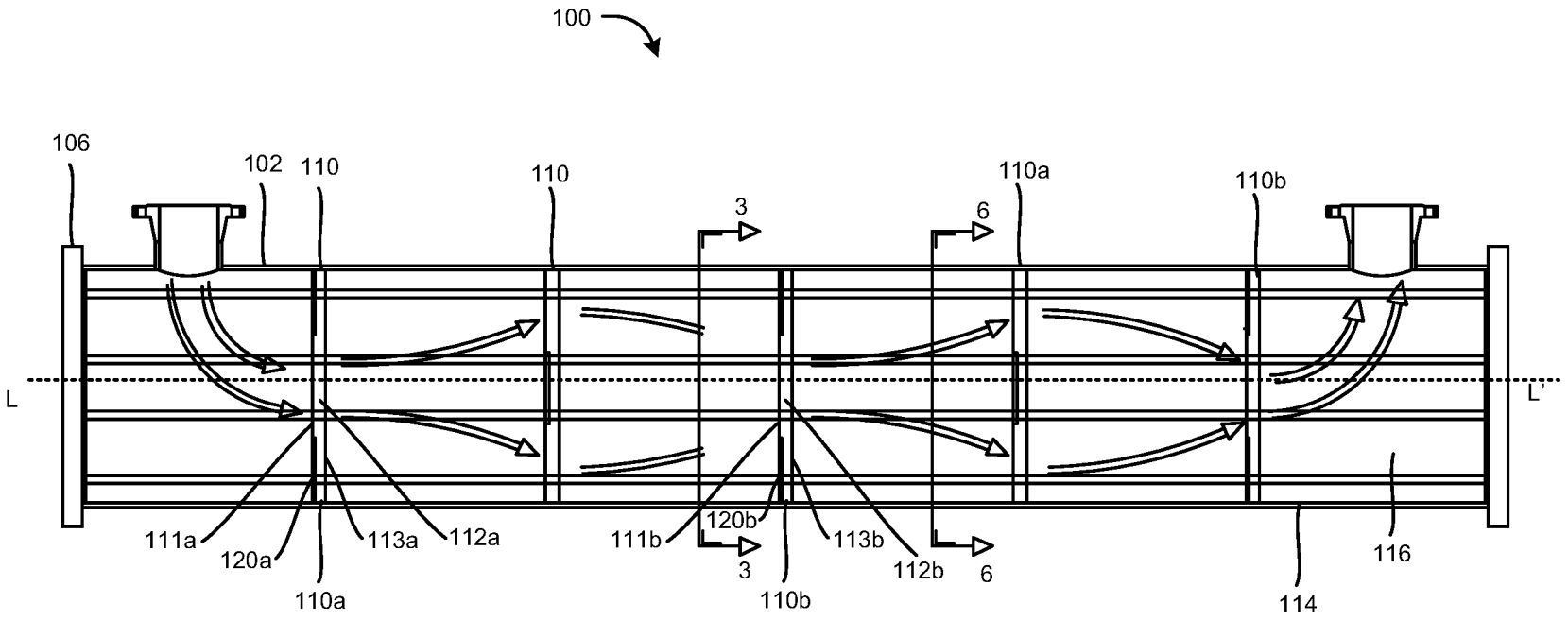
FIG. 8 is a side elevational representative cross-sectional view of a cross-section of a shell of a shell and tube heat exchanger with alternating first and second grid support and deflector assemblies according to embodiments herein positioned along the length of representative support tubes within the shell of the heat exchanger.

The grid support structures 112 for the assembly design shown in FIGS. 1-8 herein in the first grid support structure 112*a*, and second grid support structure 112*b* are provided so as to preferably extend across substantially all of the shell 108, as shown in the cross-sectional views of FIG. 8, as provided in FIG. 3 showing assembly 110*a*, and as shown in FIG. 6 showing assembly 110*b*. The grid support structures 112 preferably extend transversely across the shell. As shown, the shell 108 surrounds the assembly 110 which sits within the interior space 116 of the shell defined by the interior surface 114 of the shell 108. Each grid structure 112 has interconnected strips 119 defining passageways 118. The passageways 118 extend through the grid support structure in open grid areas from a first grid support surface to a second grid support surface as described below in a manner that is configured to support the longitudinally extending tubes 104 of the shell and tube heat exchanger 102 passing substantially perpendicularly (preferably fully perpendicularly) to the grid support surfaces from the first grid support surface to the second grid support surface without substantially obstructing shell-side flow in the heat exchanger in the open areas of the grid. The passageways as shown are of a diamond configuration, however, other configurations such as triangles, parallelograms, including squares and rectangles, ellipses and circles may be used in different grid support structure designs for different fluid flow and thermal transfer impact without departing from the spirt and scope of the invention. Further cross-support strips may also be incorporated as desired and varying grid support designs may be used including those designed and provided, e.g., as various AXI-Grid™ designs of Lindain Engineering, Marlton, NJ which have been employed in use in a variety of heat exchanger end applications.

In embodiments herein the grid support structures 112*a*, 112*b*, each have a respective first surface 111*a*, 111*b* and a respective opposite second surface 113*a*, 113*b* which opposite second surface is spaced from the first surface longitudinally when viewing the grid support structures in installation view within the heat exchanger, i.e., measured in the general axial flow direction through the shell such that fluid may pass through the open grid passageways 118 from the first surface 111 to the second surface 113 in areas where the grid is open and not obstructed by a deflector plate as described below. The longitudinal spacing between the first surface 111 and the second surface 113 of each grid support structure provides the thickness in the area of the grid support structure in which it is measured.

The grid support structures may be of one common thickness throughout the grid support structure from the first surface to the second surface and the first surface configured to receive one or more deflector plate(s) in a first area for obstructing flow while allowing tubes to pass therethrough.

In a preferred embodiment shown in FIGS. 1-8, the grid support structures are configured to not only receive deflector plates, but also to seat them in designated areas. As shown, the grid support structures shown have an area(s) where the thickness of the grid support structure is varied. As shown, each grid support has one or more first area(s) $A_1$ having a reduced thickness $t_1$ and a second area(s) $A_2$ having a larger thickness $t_2$ otherwise known as the full grid thickness herein. The reduced thickness areas $A_1$ provide an area to receive and also seat one or more deflector plates 120, wherein each deflector plate has a first deflector plate surface 121 and an opposite second deflector plate surface 123. In respective assemblies herein in FIGS. 1-8, these plates are shown as first deflector plate(s) 120*a* with first and second surface(s) 121*a*, 123*a*, and a second deflector plate(s) 120*b*, with first and second surface 121*b*, 123*b*. The deflector plates 120*a*, 120*b* are each seated in a low thickness area $A_1$ of thickness $t_1$. The thickness $t_1$, $t_2$ of each grid support structure in each area $A_1$, $A_2$ is measured from the first surface 121 to the second surface 123 in the longitudinal direction of the grid in its installation configuration as shown in FIGS. 2-7. If a change in thickness is employed to create a seat for the deflector plate, instead of just installing the plate on a grid of common thickness throughout the support structure, the thickness may vary from 0.028 in. to 0.083 in. in thickness and to offset the overall thickness, if desired, by the thickness of the deflector plate used, which could typically be expected to vary from about 0.03 in. to about 0.25 in.

The first surface of the deflector plate(s) 121 and the first surfaces of the grid support structure(s) 112 herein are preferably aligned to be facing in the same direction longitudinally along the tube bundle within the shell 108 of the heat exchanger 102. Further, the second surface 123 of a deflector plate preferably contacts the first surface 111 of a grid support structure 112 in an area $A_1$, which in the embodiment shown is also an area of reduced thickness in preferably direct engagement. If the thickness were constant, area $A_1$ would designate the area in which the grid support structure 112 receives the deflector plate(s) 121.

Such deflector plates 120 are preferably formed of materials similar to the those used to form the grid structure, but need not be. They should have sufficient strength and properties to resist corrosion and provide structural support, and sufficient thickness in the area in which they are received, or in the embodiment shown, seated and received, of the support grid structure to provide adequate life and wear.

The first surfaces 111, 121 of the grid support structures and deflector plates are also preferably aligned to face oncoming upstream shell-side flow from the shell inlet, to thereby readily align substantially axial flow through the open grid passageways 118 around the tubes 104 passing through them, and to obstruct flow using the deflector plates in other areas of the assembly, which helps to support the tubes while contributing to cross-current flow for enhanced thermal transfer efficiency.

The deflector plates may have varied thicknesses which are dictated by the ability, if desired, to act as further support in the manner of a tube sheet when the tubes pass through receiving holes in the deflector plates 120. Each deflector plate defines a plurality of tube receiving openings 122 that extend through the deflector plate from the first deflector plate surface 121 to the second deflector plate surface 123, with the openings 122 preferably aligned with openings through the attached grid support structure so that the tubes may pass through the deflector plate and further through the support grid structure for additional support.

The openings 122 may be designed to allow for thermal expansion of the tubes based on appropriate expansion tolerances, may be much wider and still allow for axial flow around the tube and substantial deflection by the deflector plate, or may be welded or otherwise made to block area around the tube even accounting for expansion using flanges and the like for complete flow obstruction around the tubes extending through the openings. Thus, the openings 122 may be used to modify flow patterns, flow obstruction or tube support depending on the desired resistance to vibration, thermal exchange demands and desired flow, if any, around the tubes as they extend through the deflector plate.

The deflector plates may be configured in a variety of shapes. In FIGS. 1-8 they are shown as having either a centrally extending region (as in FIGS. 5-7) with arcuate end features as the reach the edge of what is shown as a circular-designed grid support structure, or they may form arcuate end plate(s) conforming to the grid support structure shape (as in FIGS. 2-4). It should be understood however, that deflector plates may be provided as strips, circles, "donuts" or other configurations depending on desired flow patterns within the shell. A further example of an alternative deflector plate design is described further below.

The peripheral exterior 124 around the deflector and grid support assemblies 110 is preferably configured to substantially conform to the interior surface 114 of the shell and extend across a transverse cross-section of the interior space 116 defined by the shell's interior surface 114 for impacting flow patterns while allowing substantially axial flow through the open grid areas $A_2$ in the assemblies, while substantially obstructing flow in the areas of the deflector plates. Such assemblies are preferably mounted to the shell in a structurally stable manner as through fasteners, flanges, welding, riveting and the like. In one embodiment the peripheral exterior 124 may include a containment structure 126, for example, an outer rim or similar device support, for securing the deflector and grid support structure assembly within the rim, which may then be used for mounting to the assembly to the shell 108.

The deflector plates may be received, or received and seated, within the grid support structures and the deflector plates may be connected to grid support structures using any attachment method known to those in the art, including by welding, bolting, and other mechanical devices or means, such as through brackets or fasteners, such as bolts, rivets and the like. However, it is also possible to use other attachment means, including adhesives, molded structures and the like depending on the thermal conditions in the shell and tube heat exchanger into which they will be employed. The invention may also include, for some materials, the molding the grid support structure and deflector plate constructions as assemblies or fabricating them as a unit by other manufacturing techniques.

As shown, alternating embodiments of assemblies 110*a* and 110*b* may be used wherein the deflector plates in each assembly are not axially aligned to create a flow pattern as shown by arrow F in FIG. 8, wherein flow passes through open grid areas $A_2$ in the grid support structures of the assemblies and is deflected and substantially or completely obstructed in the areas $A_1$ of the assemblies where the deflector plates are positioned. The assemblies are thus situated to direct shell side fluid flow to pass substantially axially through the second, open grid, areas $A_2$ of the grid support structures 112*a*, 112*b* in the assemblies 110*a*, 110*b* and to substantially obstruct, or completely obstruct, flow through the first areas $A_1$ of the grid support structures 112*a*, 112*b* that receive, or seat and receive, the deflector plate(s) 120*a*, 120*b*. The flow while moving generally axially from an upstream shell-side flow through the shell 108 (meaning it is moving generally along the longitudinal axis or parallel to it in an overall flow path), is allowed to vary in and out of the open grid areas to provide some degree of directional curving in and around the deflectors to allow controlled cross-current flow and provide better circulation of the shell side flow around the tubes and increase residence time of the fluid to enhance thermal exchange within the shell for improved heat exchange efficiency. The variations and placement of the assemblies maintains generally axial flow and helps to alleviate sudden pressure drops or variations that can be problematic. The deflector and grid support assemblies' function to provide strength and reduced vibration using the combination of the support of the deflectors, the grid support structures and the end tube sheets to better prolong the life and operation of the tubes and avoid issues with structural damage.

Also provided herein is a method of heating or cooling a fluid in a shell and tube heat exchanger using the assemblies herein. The assemblies may be designed for varying end uses and thermal property by modifying the grid support structure in thickness or material, as well as interconnecting designs and patterns as well as by modifying the shapes, thickness or elevational features (if any) and locations on the grid structure of the deflector plates. The same assembly may be used throughout but installed, for example, in a rotated manner to provide variations of deflection at different degrees with respect to the axial alignment of the deflector plates in the assemblies. Alternating designs such as 110*a*, 110*b* alternating with just two or a plurality of such plates in an alternating arrangement along the length of the tube bundle with deflector plates not axially aligned can provide a different flow configuration.

Circular deflector plates dispersed around the periphery may also be used to achieve similar, varied, flow path effect. In a further embodiment generally referred to as 200, is shown with respect to various deflector and grid assemblies 210*a*, 210*b* and 210*c* in FIGS. 9-11, respectively, wherein analogous numbers refer to analogous components in each of the embodiments herein.

Each of the assemblies 210 may be used alone to enhance flow and efficiency in a heat exchanger, or two, three or more of them may be used in a repeating manner, a random pattern or in an alternating embodiment similar to that described above with respect to FIG. 1 and FIG. 8 and embodiment 110. Further, different assemblies may be used together or in tandem with other embodiments described elsewhere herein and/or with or instead of prior art grid structures or baffle designs.

Figure 9:
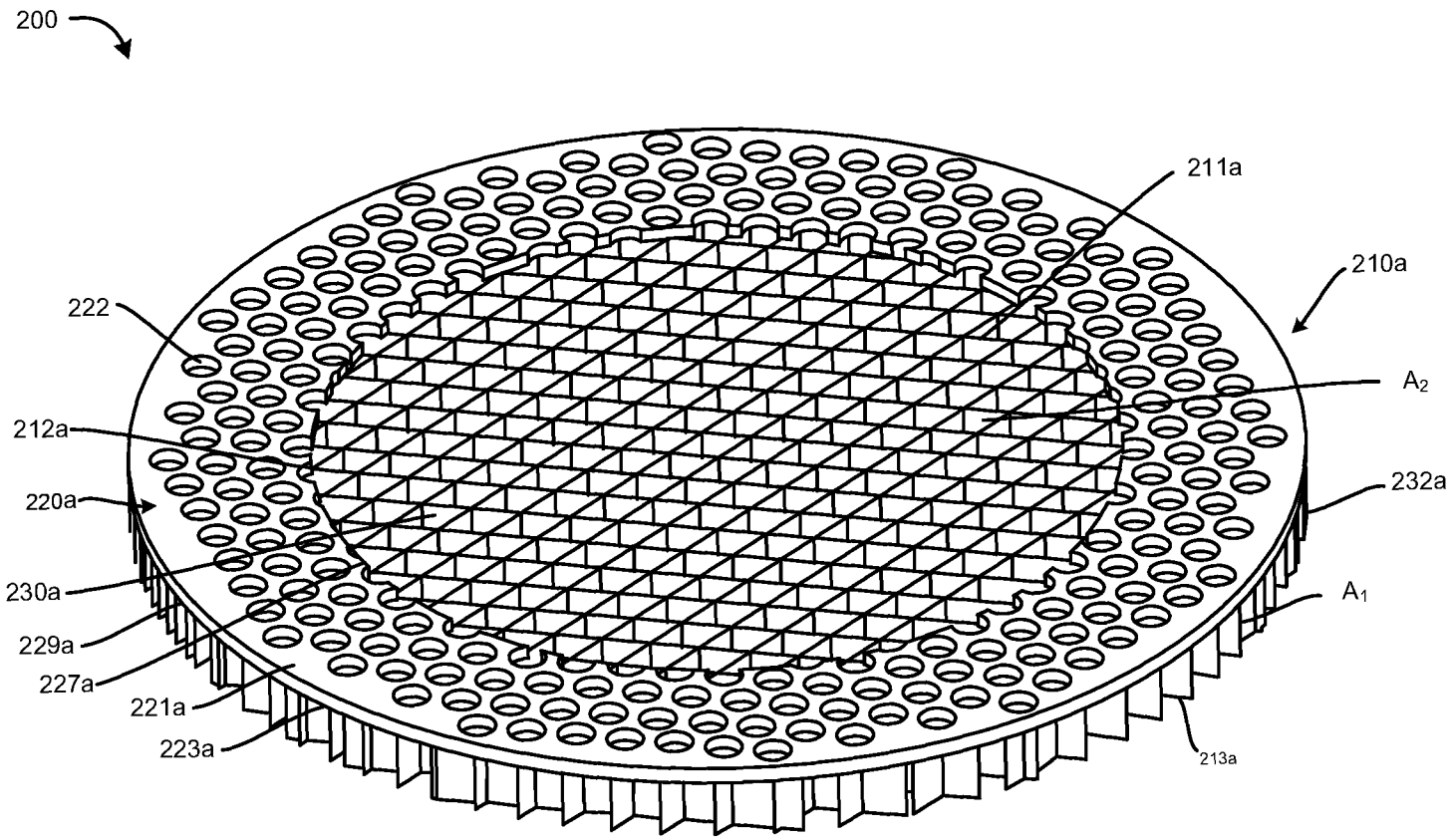
FIG. 9 is a perspective view of a first deflector and grid support structure assembly according to a further embodiment herein.

In FIG. 9, a first deflector and grid support structure assembly 210*a* is shown as leaving an open grid support structure 212*a* with an open area $A_2$ in a central region. The deflector plate 220*a* has an exterior edge 229*a* and an interior edge 227*a* of a first ring-shaped deflector plate 220*a* that defines an opening 230*a*. The open grid area $A_2$ in the central region when the deflector plate 220*a* is received on the grid support structure 212 is thus defined within the opening of the deflector plate. The deflector plate 220*a* is positioned so as to obstruct flow in a first area $A_1$, which is defined along an outer periphery 232*a* of the grid support structure 212*a*. As shown, the deflector plate 220*a* is received by and positioned on the first surface 211*a* of the grid support structure 212*a* but is not seated in a recessed area with a different longitudinal thickness as in the embodiment 100. As noted above, using a different thickness and seating the deflector is preferred but not necessary within the invention. Embodiment 200 shown in FIGS. 9-11 does not show a "seated" deflector, but could be readily modified in the manner of embodiment 100 to provide such seated area by using varying thickness in the grid support structure 212 of embodiment 200.

Figure 10:
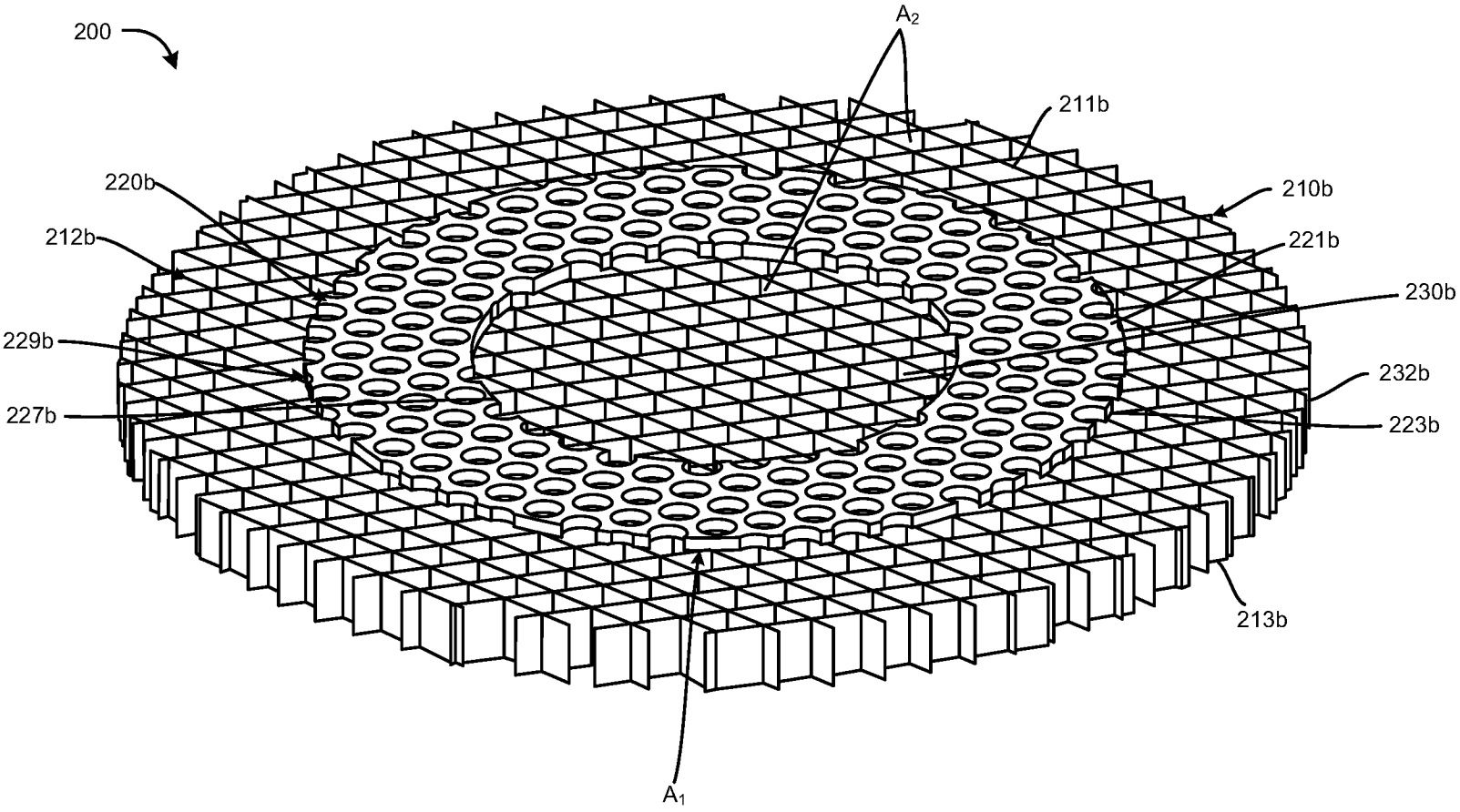
FIG. 10 is a perspective view of a second deflector and grid support structure assembly according to the embodiment of FIG. 9.

FIG. 10 shows a second deflector and grid support structure assembly 210*b*, in which a deflector 220*b* is received on a first surface 211*b* of a grid support structure 212*b*. The deflector plate 220*b* is also a ring-shaped deflector similar to that of 220*a*, and has an exterior edge 229*b* and an interior edge 227*b* that defines an opening 230*b*, but the ring is not sized to extend to the outer periphery 232*b* of the grid support structure 212*b*. Instead, the ring-shaped deflector plate 220*b* is sized to leave an outer open grid area 212*b* along the outer periphery 232*b* of the assembly 210*b* and to further leave a central region of open grid support structure 212*b* positioned within the opening 230*b* defined by the interior edge 227*b* of the deflector plate 220*b*. In this assembly, there are two open grid support structure areas $A_2$ and one obstructed grid support structure area $A_1$ which lies beneath the ring-shaped deflector plate 120*b* in FIG. 10.

Figure 11:
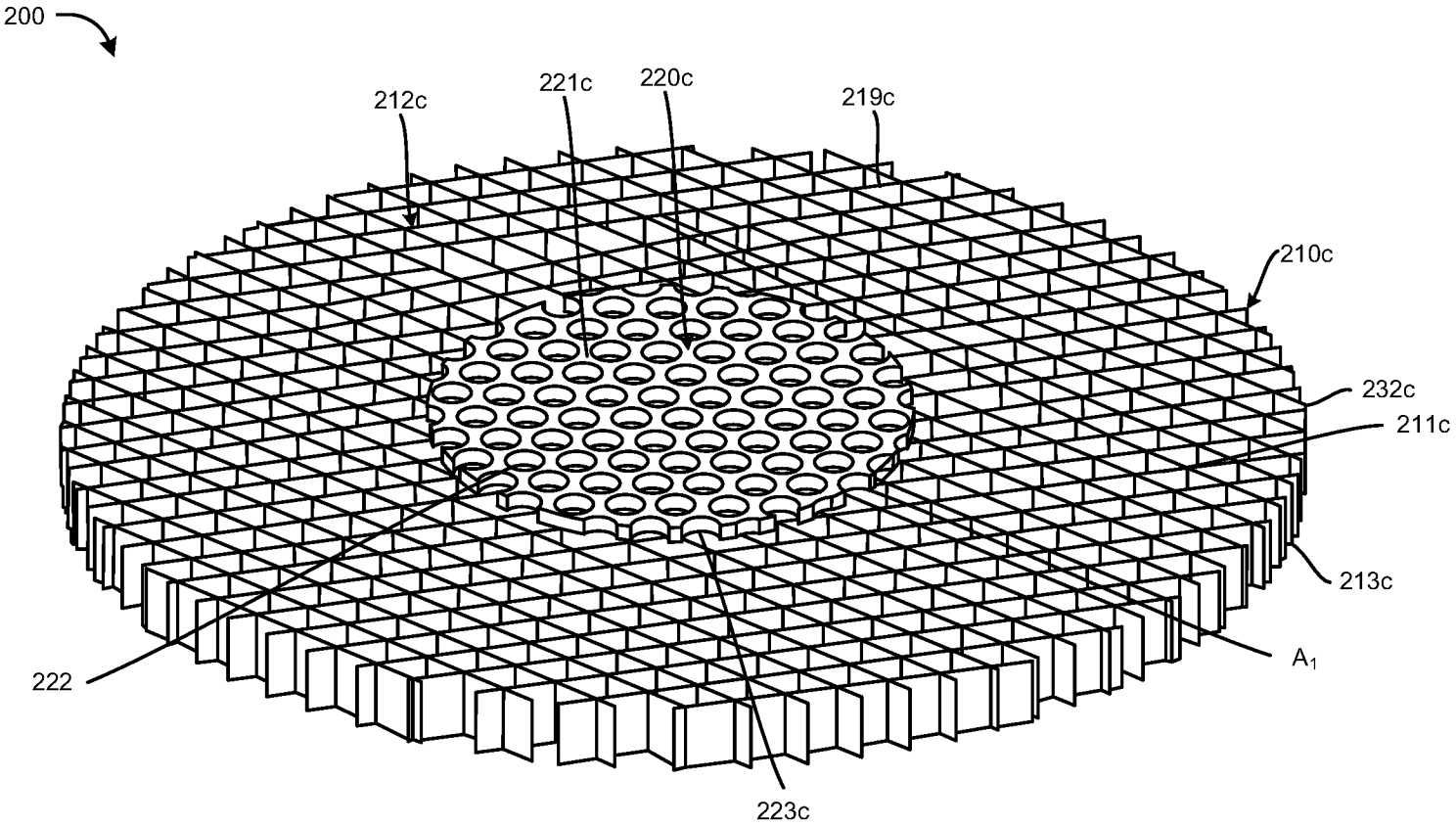
FIG. 11 is a perspective view of a third deflector and grid support structure assembly according to the embodiment of FIGS. 9 and 10.

In a third deflector and grid support structure 210*c* shown in FIG. 11, a grid support structure 212*c* has a more enlarged outer peripheral area $A_2$ of open grid support structure than that of the assembly 210*b*, however, there is no open grid region in the center of the assembly. Instead, a round plate deflector plate 220*c* is positioned in a central area $A_1$ of the assembly where obstructed grid support structure flow is located. The central, round deflector plate 220*c* is positioned so as to allow peripheral flow around the deflector, but obstruct central grid flow.

In each of assemblies 210*a*, 210*b* and 210*c*, the deflector plates include tube receiving openings 222*a*, 222*b* and 222*c*, respectively to allow tubes to pass therethrough after passing through the grid support structure, however, the deflector plates 210*a*, 210*b* and 210*c* each substantially or completely obstructs flow in areas $A_1$ of the grid support structure 212*a*, 212*b*, 212*c* where the first surface 211*a*, 211*b*, 211*c* of the grid support structure is in respective contact with the second surface 223*a*, 223*b* and 223*c* of the respective deflector plates 220*a*, 220*b* and 220*c*. The areas $A_2$ of the grid support structure not in contact with the deflector plates allow for substantially axial flow through the grid support structure.

In viewing each of the assemblies, it is apparent that the deflectors may be sized and spaced to create coordinated, alternating flow patterns wherein 210*a*, 210*b* and 210*c* assemblies may be alternating to allow a narrow central flow, a further narrowed central flow with an additional peripheral flow and a blocked central flow and enlarged peripheral flow as shell side flow passes through each alternating assembly. Further, the arrangement of the assemblies could be varied and the size of the deflectors changed to modify the effects to encourage a desired heat exchange efficiency by cross-current flow and turbulence created by the deflector plate configurations to enhance heat exchange and residence time in the shell while allowing otherwise for substantially axial flow through the shell.

It will be understood by one skilled in the art, based on this disclosure that a variety of configurations may be designed for varying thermal and flow patterns within the scope and spirt of the invention herein. Further, tube bundle density can be modified, i.e., the pitch to tube diameter ratio may be varied as much as desired or necessary to reduce velocity and pressure drop. The pitch to tube ratio could be expected to vary from about 1.25 to 2.0 in a given design. The number and extent of deflector plates may also be varied to create multiple shell streams to establish the number of tubes that are crossed by each fluid stream as determined using computational fluid dynamics (CFD) programs and other flow modeling methods to further optimize the thermal and hydraulic performance of the above-referenced modular deflector and grid support assemblies for use in varying heat exchanger designs using the principles and beneficial design aspects as noted above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A deflector and grid support assembly for use in a heat exchanger, comprising:

a grid support structure formed of a series of interconnected strips and having a peripheral exterior configured to be positioned, once installed in a heat exchanger, within an interior space defined by an interior surface of the heat exchanger such that the grid support structure substantially extends across a transverse cross-section of the interior of a shell of the heat exchanger, wherein the grid support has a first grid surface and an opposite second grid surface longitudinally spaced from the first grid surface, the grid support structure defines a plurality of passageways extending therethrough from the first grid support surface to the second grid support surface, the passageways being configured to support longitudinally extending tubes passing substantially perpendicularly to the first grid support surface through the passageways from the first grid surface to the second grid surface without substantially obstructing flow exterior to longitudinally extending tubes positioned in the passageways; and at least one deflector plate, each deflector plate having a first deflector plate surface and an opposite second deflector plate surface, wherein the at least one deflector plate defines a plurality of tube receiving openings therethrough for supporting, once installed in the heat exchanger, longitudinally extending heat exchanger tubes, the deflector plate configured to cover at least one or more surface areas of the first grid surface to substantially obstruct flow through the deflector plate;

wherein the first grid surface is configured to receive the at least one deflector plate to form a deflector and grid support assembly; and wherein either (i) the grid support structure has a first area having a first thickness measured longitudinally from the first grid surface to the second grid surface and a second area having a second thickness measured longitudinally from the first grid surface to the second grid surface, wherein the first area is on at least one exterior area of the grid support structure and the first thickness is less than the second thickness and the at least one exterior area having the first thickness is configured to receive and seat the at least one deflector plate or (ii) the grid support structure has a first area having a first thickness measured longitudinally from the first grid surface to the second grid surface and a second area having a second thickness measured longitudinally from the first grid surface to the second grid surface, wherein the first area is on at least one central area of the grid support structure and the first thickness is less than the second thickness, and the at least one central area is configured to receive and seat the at least one deflector plate.

2. The deflector and grid support assembly according to claim 1, wherein the interconnected strips comprise a metal, a metal alloy, a polymer and/or a polymeric composite.

3. The deflector and grid support assembly according to claim 1, wherein the interconnected strips, when viewed from the first or the second grid surface define passageways having a shape selected from a diamond, a triangle, a parallelogram, a square, a rectangle, an ellipse, and a circle.

4. The deflector and grid support assembly according to claim 1, wherein the peripheral exterior of the grid support structure is seated within a containment structure.

5. The deflector and grid support assembly according to claim 1, wherein the grid support surface is configured, such that upon installation in the heat exchanger, the first grid surface and the at least one deflector plate would contact upstream fluid flow.

6. The deflector and grid support assembly according to claim 1, wherein the peripheral exterior of the grid support structure is configured for being positioned within a shell of a shell and tube heat exchanger upon installation.

7. The deflector and heat exchanger assembly according to claim 1, wherein there are at least three deflector and grid support assemblies, each of which assemblies has a grid support structure having a first area and a second area, wherein a first deflector and grid support assembly has a first deflector plate that is configured as a first ring-shaped plate having an exterior edge and an interior edge, the interior edge defining an opening in a central portion of the deflector plate, the first deflector plate positioned in the first area defined along an outer periphery of the grid support structure of the first deflector and grid support assembly to allow for substantially axial flow through a central second area in the grid support structure which is not in obstructed by the first deflector plate;

a second deflector and grid support assembly has a second deflector plate that is configured as a second ring-shaped plate having an exterior edge an and an interior edge, the interior edge defining an opening in central portion of the second deflector plate, the second deflector plate positioned in a first area of the grid support structure of the second deflector and grid support assembly to allow for substantially axial flow through a second area of the grid structure of the second deflector and grid support assembly including an exterior peripheral region and a central region, each of which is not obstructed by the second deflector plate; and a third deflector and grid support assembly has a third deflector plate that is configured as a round plate positioned in a central first area of the grid support structure of the third deflector and grid support assembly to allow for substantially axial flow through a second area of the grid structure of the third deflector and grid support assembly that includes an exterior peripheral region which is not obstructed by the third deflector plate.

8. A heat exchanger having a deflector and grid support assembly, comprising a longitudinally extending shell having an exterior surface and an interior surface defining an interior space, the shell defining an inlet for shell side fluid entering the interior space of the shell, an outlet for shell side fluid exiting the interior space of the shell, an inlet for tube side fluid entering the interior space of the shell and an outlet for tube side fluid exiting the interior space of the shell;

a plurality of longitudinally extending tubes, each having an inlet on one end and an outlet on an opposite end, wherein the tubes are supported on at least one end by a tube support structure and wherein each tube inlet is in fluid continuation with the tube side fluid inlet of the shell and each tube outlet is in fluid communication with the tube side fluid outlet of the shell;

and at least one deflector and grid support assembly, each deflector and grid support assembly comprising a grid support structure formed of a series of interconnected strips and having a peripheral exterior configured to be positioned within the interior surface of the shell such that the grid support structure substantially extends across a transverse cross-section of the interior space of the shell, wherein the grid support structure has a first grid surface and an opposite second grid surface longitudinally spaced from the first grid surface, the grid support structure defines a plurality of passageways extending therethrough from the first grid support surface to the second grid support surface, the passageways being configured to support a first portion of the longitudinally extending tubes so that the tubes pass substantially perpendicularly through the first grid support surface and within the passageways from the first grid surface to the second grid surface without substantially obstructing flow exterior to the longitudinally extending tubes positioned in the passageways;

at least one deflector plate, each deflector plate having a first deflector plate surface and an opposite second deflector plate surface, wherein the at least one deflector plate defines a plurality of tube receiving openings therethrough for supporting a second portion of the longitudinally extending tubes, the deflector plate configured to cover at least one or more surface areas of the first grid surface to substantially obstruct flow through the deflector plate; and wherein the first grid surface is configured to receive the at least one deflector plate to form a deflector and grid support assembly, and wherein (i) the grid support structure has a first area having a first thickness measured longitudinally from the first grid surface to the second grid surface and a second area having a second thickness measured longitudinally from the first grid surface to the second grid surface, wherein the first area is on at least one exterior area of the grid support structure and the first thickness is less than the second thickness and the at least one exterior area having the first thickness is configured to receive and seat the at least one deflector plate; or (ii) the grid support structure has a first area having a first thickness measured longitudinally from the first grid surface to the second grid surface and a second area having a second thickness measured longitudinally from the first grid surface to the second grid surface, wherein the first area is on at least one central area of the grid support structure and the first thickness is less than the second thickness, and the at least one central area is configured to receive and seat the at least one deflector plate.

9. The heat exchanger according to claim 8, wherein there are at least two deflector and grid support assemblies, including a first deflector and grid support assembly and a second deflector and grid support assembly, and wherein the at least one deflector plate includes a first deflector plate and a second deflector plate.

10. The heat exchanger according to claim 9, wherein (a) the first deflector and grid support assembly has a first area having a first thickness measured longitudinally from the first grid surface to the second grid surface and a second area having a second thickness measured longitudinally from the first grid surface to the second grid surface, wherein the first area of the first deflector and grid support assembly is on at least one exterior area of the grid support structure, the first thickness is less than the second thickness and the at least one exterior area having the first thickness is configured to receive and seat a first deflector plate, and (b) wherein the second deflector and grid support assembly has a first area having a first thickness measured longitudinally from the first grid surface to the second grid surface and a second area having a second thickness measured longitudinally from the first grid surface to the second grid surface, wherein the first area of the second deflector and grid support assembly is on at least one central area of the grid support structure, the first thickness is less than the second thickness, and the at least one central area is configured to receive and seat a second deflector plate.

11. The heat exchanger according to claim 9, wherein the first deflector and grid support assembly and the second deflector and grid support assembly are positioned within the shell so that the at least one deflector plate of the first deflector and grid support assembly is not axially aligned with the at least one deflector plate of the second deflector and grid support assembly.

12. The heat exchanger according to claim 9, wherein the deflector plates on each of the first deflector and grid support assembly and the second deflector and grid support assembly are positioned within the shell so that the first surface of each of the deflector plates and the first surface of each of the grid support structures faces upstream shell side flow through the shell of the heat exchanger.

13. The heat exchanger according to claim 9, wherein the heat exchanger is a shell and tube heat exchanger, each of the first and the second grid support assemblies has a first surface of the grid support structure having a first area and a second area, the first deflector and grid support assembly has two deflector plates that are configured as arcuate end plates in the first area of the first deflector and grid support assembly, each arcuate end plate being separated to allow for substantially axial flow through a central grid support in the second area of the grid support structure of the first deflector and grid support assembly, wherein the second deflector and grid support assembly has one central deflector plate in its first area of the grid support structure of the second deflector and grid support assembly, the central deflector plate positioned to allow substantially axial flow through arcuate shaped end regions of the grid support structure in the second area thereof, and wherein the first and the second deflector and grid support assemblies are positioned to direct shell side flow to pass substantially axially through the second areas of the first and the second deflector and grid support assemblies and to substantially obstruct axial flow through the first areas of the first and the second deflector and grid support assemblies.

14. The heat exchanger according to claim 13, wherein the plurality of deflector and grid support assemblies comprise alternating deflector and grid support assemblies having a design of the first deflector and grid support assembly and a design of the second deflector and grid support assembly positioned along a length of the shell, as measured in a longitudinal direction, to create an alternating shell side flow pattern to increase heat transfer without inhibiting generally axial flow over and around the tubes.

15. The heat exchanger according to claim 8, wherein there are at least three deflector and grid support assemblies, each of which assemblies has a grid support structure having a first area and a second area, wherein a first deflector and grid support assembly has a first deflector plate that is configured as a first ring-shaped plate having an exterior edge and an interior edge, the interior edge defining an opening in a central portion of the deflector plate, the first deflector plate positioned in the first area defined along an outer periphery of the grid support structure of the first deflector and grid support assembly to allow for substantially axial flow through a central second area in the grid support structure which is not in obstructed by the first deflector plate;

a second deflector and grid support assembly has a second deflector plate that is configured as a second ring-shaped plate having an exterior edge an and an interior edge, the interior edge defining an opening in central portion of the second deflector plate, the second deflector plate positioned in a first area of the grid support structure of the second deflector and grid support assembly to allow for substantially axial flow through a second area of the grid structure of the second deflector and grid support assembly including an exterior peripheral region and a central region, each of which is not obstructed by the second deflector plate; and a third deflector and grid support assembly has a third deflector plate that is configured as a round plate positioned in a first central area of the grid support structure of the third deflector and grid support assembly to allow for substantially axial flow through a second area of the grid structure of the third deflector and grid support assembly that includes an exterior peripheral region which is not obstructed by the third deflector plate.

16. The heat exchanger according to claim 15, wherein the first, the second and the third deflector and grid support assemblies are alternating assemblies having a design of each of the first, the second and the third grid support assemblies positioned along a length of the shell, measured in a longitudinal direction, to create an alternating shell side flow pattern to increase heat transfer without inhibiting generally axial flow over and around the tubes.

* * * * *